United States Patent [19]

Carter

[11] 4,369,821

[45] Jan. 25, 1983

[54] CAM ACTUATED FILLER VALVE

[75] Inventor: Robert C. Carter, Denver, Colo.

[73] Assignee: Adolph Coors Company, Golden, Colo.

[21] Appl. No.: 248,726

[22] Filed: Mar. 30, 1981

[51] Int. Cl.[3] ..... B65B 3/04; B67C 3/28

[52] U.S. Cl. ..... 141/147; 141/268; 251/208; 251/251

[58] Field of Search ..... 141/1–12, 141/37–59, 311 R, 392, 129, 191, 144–152, 250–284; 222/168.5; 137/625.3, 625.31, 625.46; 251/205, 206, 207, 208, 209, 251

[56] References Cited

U.S. PATENT DOCUMENTS 4,253,505 3/1981 Saver et al. ..... 141/147

*Primary Examiner*—Houston S. Bell, Jr.

*Attorney, Agent, or Firm*—Klaas & Law

[57] ABSTRACT

A conventional rotary filler valve is modified for actuation by a curved surface in place of inclined plane wedges.

5 Claims, 4 Drawing Figures

CAM ACTUATED FILLER VALVE

BACKGROUND OF THE INVENTION

This invention relates to an improvement in valve actuation apparatus and more particularly to an improvement in the apparatus for actuating rotary filler valves in commercial filling machines.

Standard commercial filling equipment such as used in the beverage industry must perform according to a number of critical requirements dictated by the regulations of the Food and Drug laws for cleanliness of operation and the competitive economics of the particular industry that requires fast reliable equipment so that a high through-put of quality product is obtained.

In the field of beverage filling equipment the Cemco filling machine manufactured by Crown Cork and Seal Co. of Baltimore, Md. is representative of the kind of apparatus which is currently commercially successful. This machine utilizes a central rotating frame to the periphery of which rotary filling valves are attached. They are generally uniformly spaced apart and spatially oriented so as to be in registry with the containers to be filled that are conveyed to and from the filling machine. The filling and venting tubes for conveying beverage or compressed gases to or away from the valves radiate centrally of the circular apparatus, some forming a cone shaped array which is typically fed from the upper part of the filling machine.

The rotary valves themselves are conventionally actuated by arms on a rotary filler valve actuating member encountering wedges located in fixed positions around a stationary ring that surrounds the apparatus. As the central frame rotates and the conveyor with containers moves the containers into registry with the filling nozzel of the valves, the arms on each valve actuating member are adapted to be struck by the stationary wedges to perform the functions of opening the valve to fill the container, close the valve, introduce compressed gases and the like.

Several severe problems are encountered during such normal operation where the actuating wedges impact the protruding arms of the valve actuating member. These problems include filler machine vibration, valve actuating member seal disc wear, wedge wear, and machine down time associated with correcting the problems created by the foregoing, as well as the down time associated with adjustment of the valves, valve springs, and replacement of valve seal discs and bushings. It has been found that the frequency of occurrence of some of the foregoing problems is directly dependent upon the speed of operation which therefore practically imposes a maximum in operating speed for the user, for the operation to be commercially economical.

In particular, the opening and closing wedges for actuating the arms of a Cemco rotary filler valve actuating member have been observed to wear out at a high rate. Due to the shape of the arms, one of which is rotated forward into engagement with the inclined plane of the wedge, the arms, while being positively displaced by this configuration, tend to beat holes or pockets or recesses in the wedges. Wedges worn badly in this manner produce a bad fill upon inspection of the filling process and require replacement.

Unfortunately, the same forces that beat holes in the wedges are transmitted to the valve actuating member seal discs, bushings, valve body, valve body mounts, and vibrate the structural supports and braces of the machine as well as loosening the filler and venting tube connections. Excessive wear in these places and in the wedges means lost production both in time and rejected containers as well as unplanned maintenance.

Similarly, the valve actuating member containing the arms which strike the wedges will tend to misalign the filling ports by overtravelling the desired position. Unfortunately, to overcome this overtravel of the filling ports created by the impact of the wedges on the arms it is often necessary to overtighten the coil spring acting to seal the valve actuating member to the valve body, to prevent unwanted rotation. The additional resistance to rotary movement this creates aggravates the wedge wear and structural problems caused by the resulting increase in impact forces and vibration. The high spring load increases the wear on the valve seal surfaces resulting in additional valve leaks, maintenance and product rejection due to improper fills.

It is therefore an objective of the present invention to provide an apparatus for rotary valve actuation which reduces filler machine maintenance and down time and increases its reliable speed of operation.

It is also an objective of the present invention to reduce or eliminate the present wear rate for a filler machine caused by the use of wedges in all the valve functions.

It is a further object of this invention to reduce vibration in the operation of a beverage container filling machine and the structural problems associated therewith. It is also an objective of this invention to reduce the wear of the rotary filler valve actuating member seals, thereby reducing maintenance costs and product rejection caused by premature leaks developing between the valve actuating member and the seal.

Finally, it is an object of the present invention to provide an apparatus which can actuate a rotary valve in a manner that does not allow filling ports to misalign during the filling, counter pressure, blow down and shut off functions of the valve.

SUMMARY OF THE INVENTION

The above and further objects and advantages are achieved in a rotary valve filling machine in which each valve actuating member is provided with a cam follower arm and a cam follower which, upon rotation of the filling machine frame, is adapted to engage a stationary vertically disposed camming member containing a smooth curved surface which is slidably engaged by the cam follower thereby moving the cam follower arm and the rotary valve actuating member to which it is attached to selectively activate at least one function of the valve.

DETAILED DESCRIPTION OF THE DRAWINGS

Figure 1:
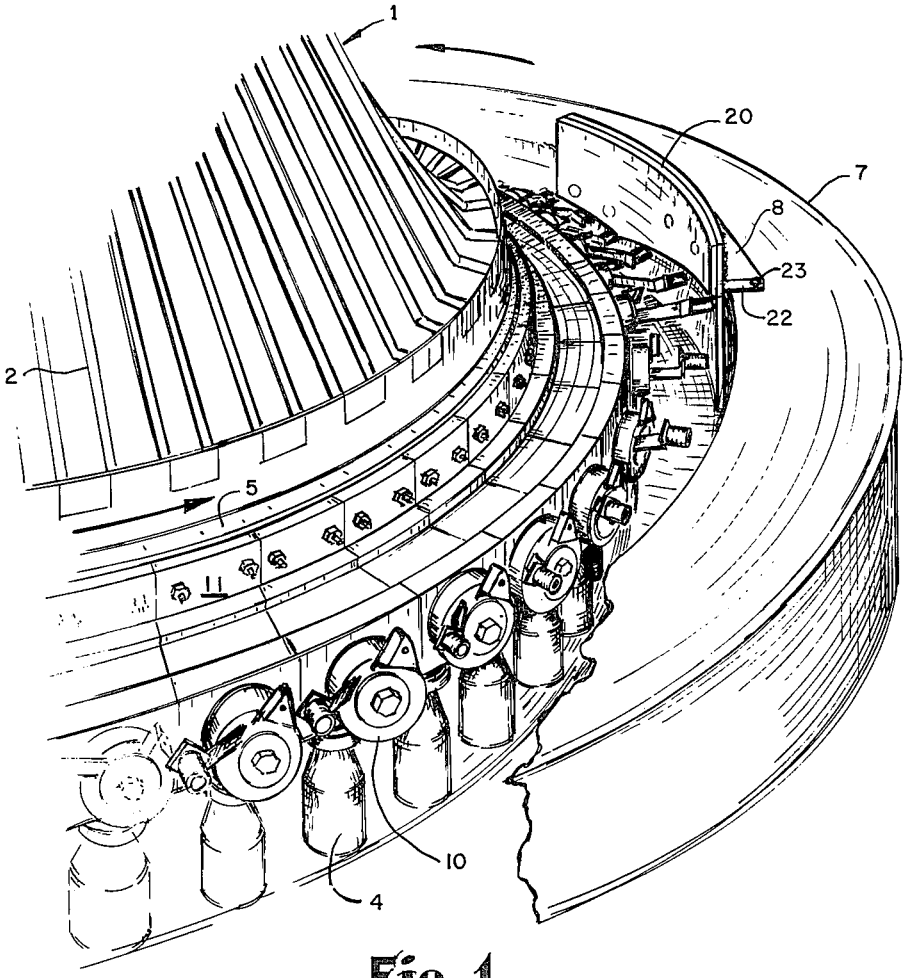
FIG. 1 is a partial perspective view of a segment of a filler machine with the cam assembly of the present invention in its operative position.

In FIG. 1 a conventional Cemco rotary valve filling apparatus Model No. 72 manufactured by Crown Cork and Seal Co. of Baltimore, Md. is shown generally as 1. These machines contain a conical array of filling and venting tubes, shown generally as 2, which can supply a fluid or compressed gases or permit venting and extend from a position above the machine, not shown, to the rotary filler valves shown generally as 10, while the frame 5 as well as the tubes 2 and valves 10 attached to the frame are rotated in the direction shown by the arrows. A ring 7 outside of the rotating frame is stationary during this movement. The bottles 4 or other containers to be filled are conveyed by a portion of the mechanism, not shown, into registry with the rotary valves 10 and move synchronously with the valve 10, frame 5 and filler tubes 2 during a filling cycle.

Figure 2:
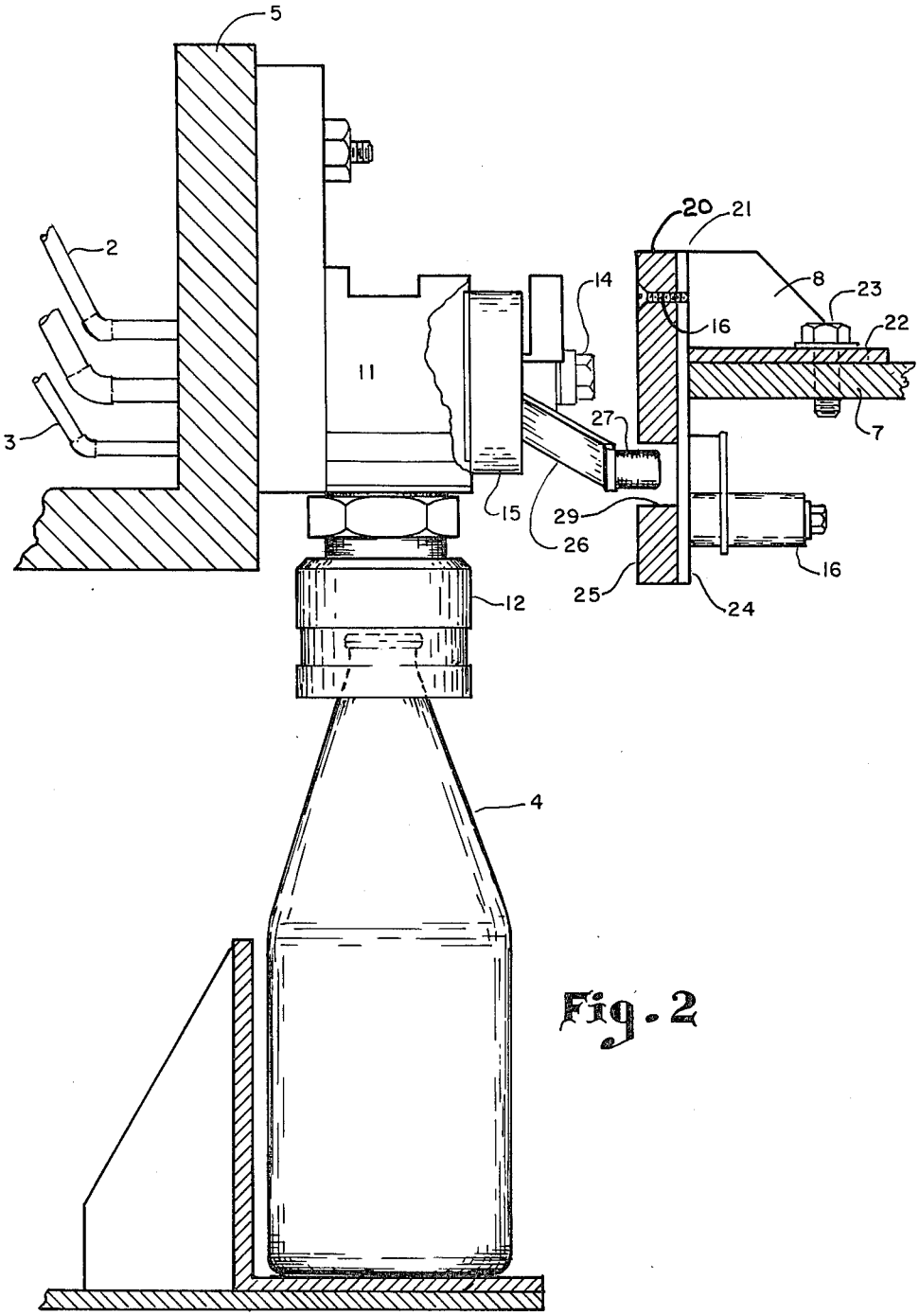
FIG. 2 is a side elevational view partially sectioned showing the operative position of a filler valve and the cam actuating mechanism of the present invention.

Referring to FIG. 2 the rotating frame 5 is shown with the filler tube 2 passing through frame 5 and connected to the valve body 11. A filler valve collar 12 is received on the bottom of the valve body 11 for engaging, in this case, the neck of a bottle 4 to be filled. The bottle is conveyed, as previously described, onto a support on a portion of frame 5 to assure registry of each bottle 4 with a valve collar 12 on a filler valve body 11. A rotary valve actuating member 15 is received on a horizontal shaft (not shown) generally perpendicular to the valve body 11 so that when the actuating member 15 is rotated or moved through a predetermined angular displacement, or arc, the valve is actuated to either permit the flow of fluid through the tube 2 attached to valve body 11 into bottle 4 or the flow of compressed gas or venting through a tube, such as 3. The valve actuating member 15 can be attached to the valve shaft by means of fastener 14.

A bracket 8 on ring 7 is provided to receive the cam actuating assembly 20.

In FIG. 2 the cam actuating assembly comprises a laid-down T-shaped bracket. The curved backing plate 21 is attached to bracket 8. A threaded fasterner 23 is used to adjustably attach this assembly to the filler ring 7. The vertical portion of bracket 21 has received on its vertical face nearest the filler valve a camming member 25 which is slotted to provide a camming action which will be more fully described hereinafter. The camming member 25 can be releaseably attached to the vertical portion 24 of bracket 21 by means of recessed head fasteners 16 so that the vertical face of the camming member 25 nearest the filler valve 10 does not contain any protrusions into the space between the vertical face 25 and the filler valve. The configuration of the apparatus described is illustrative only as it will be appreciated that there can be several brackets around the ring 7 depending on the size of the camming surface selected. Of course additional fasteners would then be required to firmly secure the cam actuating assembly where either bracket segments or a continuous configuration is selected. The number and type of fasteners for the attaching the cam assembly 20 to the bracket 8 and the camming member 25 to the T-shaped bracket 21 is a matter of design choice given the strength of materials selected for the components and the predicted stresses that may be encountered in use. Many variables must of course be analyzed for this design choice including the speed at which the filler apparatus will be rotated for a given filling rate. Appropriate choices can be made based on the design criteria selected without undue experimentation to achieve the objectives of the present invention.

Figure 3:
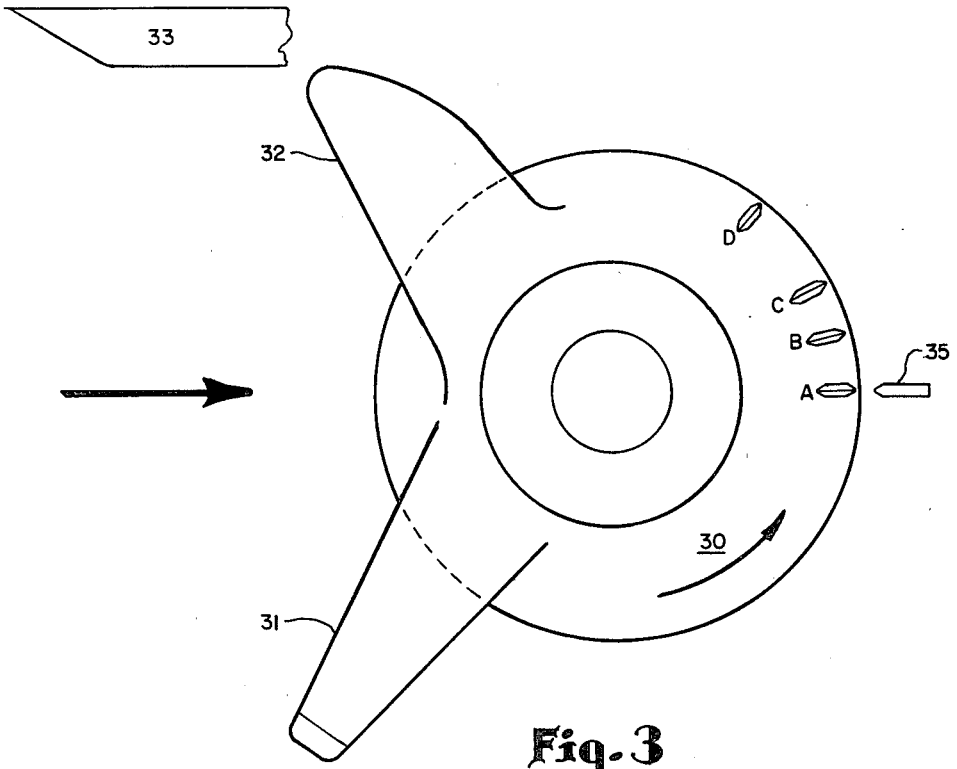
FIG. 3 is a partial front view of the actuating mechanism for a conventional filler valve actuating member.

Referring to FIG. 3 a conventional valve actuating member 30 is shown. Two arms 31 and 32 are shown protruding from the circular body of member 30 at approximately 100° apart. Closing arm 32 is actuated or rotated in the direction shown by the curved arrow by impact with a wedge 33 during movement of the valve 10 and valve actuating member 30 in the direction shown by the horizontal arrow until the closed position of the valve actuating member is achieved. This is shown as the position where registry occurs between a reference mark 35 on the valve body 10 (only the mark is shown) and the indicated positions A, B, C, and D. Position A signifies the valve closed position. The position where B would be in registry with reference mark 35 would be the blow down position. The position where C would be in registry with reference mark 35 would be the counter pressure position. The position where D would be in registry with the reference mark 35 would be the fill position for the filler valve 10.

The conventional practice is then to mount wedges, typically such the wedge 33 shown, which are attached to the ring 7 in a conventional manner at locations such that the angled faces of the wedges oppose the free movement of the opening or closing arms thereby banging them like hammers into each of the registry positions of A, B, C, and D with reference mark 35.

Figure 4:
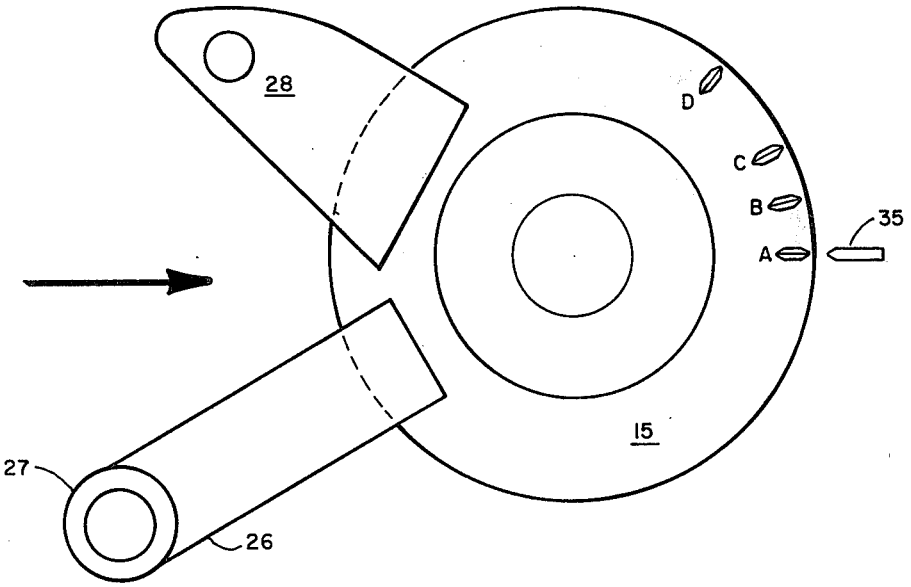
FIG. 4 is a partial front view of the actuating mechanism of the present invention for a conventional filler valve actuating member.

Referring to FIG. 4 the valve actuating member 15 of the present invention is provided with a cam follower arm 26 and an arm 28 disposed at less than 90° apart. The illustrated arm 28 is provided in the event that other valve actuation functions are desired to be accomplished in the conventional manner such as a no can/no fill function.

The cam follower arm 26 terminates at its end with a cam follower 27 which is sized to be received in the slot 29 or surface of camming member 25. The slot is shaped in a smooth curve to engage the cam follower 27 and urge it either downward, as shown in FIG. 1 or upward (not shown) in a smooth manner to achieve the requisite registry for the positions of the valve actuating member with the reference mark 35 on filler valve 10 for each function of the sequence of shut off, blow down, counter pressure and fill to be performed as selected during the rotation of the Cemco filler machine.

By providing the structure described, the wear on the valve actuating member seals, bushings and mounting fasteners of the valve body 11 is dramatically reduced enabling much higher filling speeds and therefore higher through-put of quality product than previously possible with solely a wedge actuated filler valve device. The reduction in wear due to the reduction in impact forces likewise lengthens the time between required or unscheduled maintenance therefore producing less down time due to valve problems or wedge replacement, thereby producing more economic production.

The materials selected for use in the present invention which have been found to enhance its successful application to a Cemco filling machine include coating the stainless steel valve actuating member seal surface with a Rokide brand flame sprayed coating which is lapped smooth. This and other coatings suitable for this purpose improve wear resistance. The utilization of an ultra high molecular weight polyethylene plastic, such as Hi-Fax brand of plastic supplied by Hercules Plastic Co. can be used for the camming member 25. The requisite slot or surface can be easily machined into this material and then mounted as shown on the vertical portion 24 of the bracket 21 of cam assembly 20. If desired, this material can also be provided with cut or drilled channels and appropriate fittings to introduce water or other lubricants or heat dissipating materials into the area of the slot for smoother operation where circumstances permit.

By means of the modification provided by this invention all of the requisite functions of a filler apparatus can be preserved including the present features which are self-explanatory, i.e., no can/no fill, filling, counter pressure with $CO_2$, blow down, and shut off. One of the main problems avoided by the apparatus of the present invention which was created by the overtightening of the coil spring which cooperates with the rear of the valve actuating member and the bushings and seals of the interior of the valve to prevent leakage and overtravel of the valve actuating member, is reduced or avoided since the kind of impact produced by the use of wedges is minimized. Due to the nature of the construction of a Cemco filler valve it is critical that loosening of the valve actuating member seals not occur since air may enter the system or liquids and gases escape causing a bad fill.

The present invention, by reducing the wearing of these seals, decreases the possibility of air entering or liquids and gases escaping and of mismatching of the holes for carrying these materials and therefore uniformly gives a better fill with fewer rejects and waste.

A smooth curve found to perform successfully with the apparatus of the present invention can be defined for purposes of machining as:

$$y = H\left(\frac{X}{L} - \frac{1}{2}\ \frac{\text{Sin } 360^\circ x}{L}\right)$$

The foregoing is a cycloidal curve where H is the total change in the vertical height of the smooth curve and x is the horizontal distance along the length of the cam from a reference point and the resultant y is a vertical distance on the curve from the same reference. If a standard Cemco valve is employed, with the actuating member of this invention, an H to L slope ratio of about 0.25 has been found to be best.

Other curve shapes are of course possible within the confines of the dimensions and application of the filling machine and selection of different curve shapes may be indicated where considerations such as speed, age of the equipment, kind of filling operation being performed and the like, suggest the use of a different slope at any part of the curve.

What is claimed is:

1. A rotary filling machine comprising:

a rotatable circular frame, at least one rotary valve having at least one inlet and at least one outlet mounted on the outer periphery of said frame;

valve actuation members mounted on said rotary valve including rotatable means for rotating said valve actuation member comprising:

a cam follower projecting radially outwardly from said rotary valve which when moved a predetermined amount during the rotation of said rotatable circular frame is capable of actuating said valve;

means for supplying and venting fluids, including gases, which communicate with said valve mounted on said frame;

means for conveying containers to be filled into registry with the outlet of at least one of said valves, while said frame is rotating;

means for support adjacent to the perimeter of said circular frame; and means for camming supported on said support means said camming means including a smooth curved surface defined as:

$$y = H\left(\frac{x}{L} - \tfrac{1}{2}\pi\ \frac{\text{Sin } 360^\circ x}{L}\right)$$

where H is the total change in vertical height of the smooth curve; L is the length of the smooth curve, x is the horizontal distance along the length of the curve from a preselected reference and the resultant y is a vertical distance on the curve from the same reference, whereby, when said cam follower is positioned to engage said stationary camming means during the rotation of said rotatable circular frame at least one function of said valve is actuated in a predetermined sequence depending on the position and location of said camming member.

2. The rotary filling machine of claim 1 wherein said support means includes a stationary ring having a vertical face at least partially surrounding said rotatable frame.

3. The rotary filling machine of claim 1 wherein a plurality of rotary valves are mounted on the periphery of said circular frame.

4. The rotary filling machine of claim 3 wherein said plurality of valves receive fluid from said fluid supply means from a position axially interior of the periphery of said circular frame.

5. The rotary filling machine of claim 4 wherein the outlet of said rotary valves is substantially vertically downward from the periphery of said circular frame.

* * * * *